US011499260B2

(12) United States Patent
Kim et al.

(10) Patent No.: US 11,499,260 B2
(45) Date of Patent: Nov. 15, 2022

(54) LAUNDRY TREATING APPARATUS

(71) Applicant: LG Electronics Inc., Seoul (KR)

(72) Inventors: Jong Min Kim, Seoul (KR); Bosun Chung, Seoul (KR); Doyoung Rhyu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/938,151

(22) Filed: Jul. 24, 2020

(65) Prior Publication Data

US 2021/0071339 A1 Mar. 11, 2021

(30) Foreign Application Priority Data

Sep. 5, 2019 (KR) ..... 10-2019-0110209

(51) Int. Cl.
*D06F 37/24* (2006.01)
*D06F 37/12* (2006.01)

(52) U.S. Cl.
CPC ..... *D06F 37/24* (2013.01); *D06F 37/12* (2013.01)

(58) Field of Classification Search
CPC ..... D06F 37/20; D06F 37/22; D06F 37/24
See application file for complete search history.

(56) References Cited

U.S. PATENT DOCUMENTS 6,397,643 B1 * 6/2002 Chang ..... D06F 37/24 68/23.1
2011/0308281 A1 12/2011 Yu et al.
2015/0069684 A1 3/2015 Park et al.
2016/0010259 A1 * 1/2016 Jeon ..... D06F 37/24 68/132
2016/0010260 A1 1/2016 Kim et al.
2016/0024705 A1 * 1/2016 Hernden ..... D06F 37/20 267/140.13

FOREIGN PATENT DOCUMENTS

| | | |
|---|---|---|
| CN | 101356309 | 1/2009 |
| CN | 112442848 | 3/2021 |
| JP | H10328482 | 12/1998 |
| KR | 10-2012-0029853 | 3/2012 |
| KR | 10-2012-0072833 | 7/2012 |
| KR | 10-2015-0081742 | 7/2015 |

OTHER PUBLICATIONS

Office Action in Chinese Appln. No. 202010795507.6, dated Aug. 2, 2022, 8 pages.

* cited by examiner

*Primary Examiner* — David G Cormier
(74) *Attorney, Agent, or Firm* — Fish & Richardson P.C.

(57) ABSTRACT

A laundry treating apparatus includes a main body and a washing tub. The main body and the washing tub are coupled to each other through a suspension assembly. The suspension assembly includes a support rod, an elastic member, and a damper. The support rod is formed in a rod shape, and one end of the support rod is coupled to the main body. The elastic member is arranged about the support rod to surround the support rod. The damper is supported on the elastic member, and is configured to move along the longitudinal direction of the support rod. In addition, the damper is coupled to an outer circumference of the support rod, and forms a compartment, which is an empty space surrounding the support rod. The compartment is provided with a friction member.

16 Claims, 14 Drawing Sheets

LAUNDRY TREATING APPARATUS

CROSS-REFERENCE TO RELATED APPLICATION

The present application claims benefit of priority to Korean Patent Application No. 10-2019-0110209, entitled "LAUNDRY TREATING APPARATUS," filed on Sep. 5, 2019, in the Korean Intellectual Property Office, the entirety of which is incorporated by reference herein.

TECHNICAL FIELD

The present disclosure relates to a laundry treating apparatus, and more particularly, to a laundry treating apparatus capable of improving both performance of supporting a load of a washing tub and performance of dampening vibration occurring during operation of the washing tub.

BACKGROUND

In general, laundry requires several forms of treatment, such as washing, drying, storing, and ironing. To this end, laundry treating apparatuses that separately perform the treatments such as washing, drying, storing and ironing have been implemented. Alternatively, laundry treating apparatuses that may perform, for example, an integrated washing and drying function or an integrated storing and ironing function have also been implemented.

In particular, laundry treating apparatuses for performing washing are largely classified into two types according to a washing method. Specifically, the types of the laundry treating apparatuses may be classified according to whether a rotating cylindrical washing tub is vertically or horizontally disposed. The laundry treating apparatus in which the washing tub is horizontally disposed is called a drum-type, and the laundry treating apparatus in which the washing tub is vertically disposed is called a pulsator-type (or volute-type) or agitator-type.

The above two types of the laundry treating apparatuses differ in terms of a loading direction of laundry or a direction of a rotation axis of an inner tub, but are similar in terms of a configuration in which an outer tub is provided to receive washing water and the inner tub is rotatably disposed inside the outer tub. When the laundry, together with washing water, rotates inside the washing tub, vibration occurs repeatedly in the washing tub. Due to this vibration, the washing tub may collide with or come into contact with nearby structures.

Accordingly, vibration dampening devices are installed inside a main body of the laundry treating apparatus, which are configured to dampen vibration occurring in the washing tub while supporting the load of the washing tub.

The vibration dampening devices can enable noise reduction and stable rotation of the inner tub by reducing vibration or shaking occurring in the washing tub.

In this regard, Korean Patent Application Publication No. 10-2012-0072833 (hereinafter referred to as 'Related Art 1') discloses 'a suspension for a washing machine'.

Related Art 1 discloses a body coupled to a tub (an outer tub) of the washing machine and having a buffering space formed therein, a support rod passing through the body so as to be movable along an axial direction and having a support plate installed at an end thereof, an elastic member arranged to surround the support rod and to allow the support plate to elastically support the body, and a friction member disposed in the buffering space and coming into close contact with an outer circumference of the support rod to generate a frictional force.

Since the friction member disclosed in Related Art 1 is capable of linear movement within the buffering space, when vibration or a load of the tub is applied, a phenomenon in which the receiving portion surrounding the friction member comes into contact with an inner wall of the buffering space and then moves apart therefrom is repeated. Accordingly, Related Art 1 has a disadvantage in that intermittent noise occurs inside the body due to friction.

In addition, in Related Art 1, the friction member continuously collides with the outer surface of the support rod due to vibration of the tub. Accordingly, Related Art 1 has a disadvantage in that when the washing machine is operated for a long time or when a large vibration occurs in the tub, the efficiency of attenuating the impact is significantly reduced due to friction heat occurring in the support rod or the friction member.

Korean Patent Application Publication No. 10-2012-0029853 (hereinafter referred to as 'Related Art 2') discloses 'a washing machine'.

Related Art 2 discloses a casing forming the exterior of the washing machine, a support rod having one end coupled to the casing, and a suspension coupling an outer tub to the other end of the support rod such that the outer tub is suspended from the casing in order to dampen vibration of the outer tub. The suspension includes an air cap through which the support rod passes and which moves along the support rod when the outer tub vibrates, a first friction member that is disposed in the air cap to come into contact with an inner surface of the air cap, and a second friction member disposed to come into contact with the support rod.

Related Art 2 also has a disadvantage in that when large vibration occurs in the outer tub, since a friction damper comes into contact with the inner wall of the air cap, loud noise may occur.

In addition, Related Art 2 has a disadvantage in that since the first friction member and the second friction member of the friction damper pressurize both the inner surface of the air cap and the support bar, respectively, while positioned between the inner surface of the air cap and the support bar, the air cap may be prone to breakage, which in turn provides a relatively low durability.

In addition, Korean Patent Application Publication No. 10-2015-0081742 (hereinafter referred to as 'Related Art 3') discloses 'a damper and washing machine including the same'.

Related Art 3 includes a damper provided in a cabinet so as to dampen vibration of a tub. The damper includes a suspension rod having one end coupled to the cabinet, a moving member coupled to an outer side of the suspension rod so as to move along the suspension rod integrally with the tub, a support member coupled to the other end of the suspension rod, and a shock-absorbing member provided between the moving member and the support member so as to vary by vibration transmitted from the tub. In addition, a lubricant receiving portion that may be filled with a predetermined lubricant is formed on the contact surface of the suspension rod and the moving member.

However, Related Art 3 further includes, in addition to the above-described components, a friction member formed of rubber and felt. In addition, in Related Art 3, since the friction member is tightly received without any empty space in the second pipe, which is a space formed in the body, when the moving member moves along the suspension rod, the friction member changes in appearance due to friction with the suspension rod. In addition, since the friction member is pushed to one side due to friction with the suspension bar, the friction member cannot evenly press the portion surrounding the suspension bar. In Related Art 3, the friction member cannot stably dampen vibration.

In addition, although Related Art 3 discloses an embodiment in which the friction member and the lubricant are disposed adjacent to each other, it has a disadvantage in that since the friction member and lubricant are positioned in different areas, lubrication and heat dissipation efficiency is poor.

The above-described background technology is technical information that the inventors have held for the derivation of the present disclosure or that the inventors acquired in the process of deriving the present disclosure. Thus, the above-described background technology cannot be regarded as known technology disclosed to the general public prior to the filing of the present application.

SUMMARY

The present disclosure is directed to addressing a disadvantage in the art in which, since a force is concentrated on a part of a damper for dampening a vibration in the process of dampening the load and vibration of a washing tub, buffering efficiency is poor.

The present disclosure is further directed to addressing a disadvantage in the art in which noise occurs due to vibration occurring in a washing tub.

The present disclosure is further directed to addressing a disadvantage in the art in which, since heat generation by friction occurs in a damper for dampening vibration occurring in a washing tub, buffering efficiency is poor due to the heat generation.

The present disclosure is still further directed to addressing a disadvantage in the art in which a number of components must be assembled in a complicated manner to absorb shock or vibration occurring in the washing tub.

The present disclosure is still further directed to addressing a disadvantage in the art in which a friction part of a damper for absorbing shock or vibration occurring in a washing tub is prone to breakage due to friction or to have a shortened life.

The present disclosure is not limited to what has been disclosed hereinabove. A person skilled in the art may clearly understand, from the following description, other aspects not mentioned above.

In the laundry treating apparatus according to an embodiment of the present disclosure, since a friction member is disposed in a compartment and a space around the friction member is filled with a lubricant, a frictional force between a support rod and the friction member can be evenly generated, and thus an external force can be smoothly distributed.

In the laundry treating apparatus according to an embodiment of the present disclosure, since a friction member disposed in a damper is constrained to move vertically and a space around the friction member is filled with lubricant, noise caused by vibration of the washing tub can be reduced.

In the laundry treating apparatus according to an embodiment of the present disclosure, since a compartment is formed in a damper and the compartment is filled with a lubricant, heat inside the damper can be dissipated, In the laundry treating apparatus according to an embodiment of the present disclosure, since a friction member is interposed between a fixing guide and a support rod and the friction member may be made of a plurality of small pieces, the number of components constituting a damper can be reduced and an assembly of the components can be facilitated.

In the laundry treating apparatus according to an embodiment of the present disclosure, since a friction member is constrained to move in the direction in which an external force is applied, and is pressed toward a support rod by a fixing guide and a lubricant, shock can be prevented from being applied to a damper, Specifically, a laundry treating apparatus according to an embodiment of the present disclosure includes a main body and a washing tub. A receiving space is formed in the main body. The washing tub is coupled to the main body through a suspension assembly. A space for receiving water and laundry is provided in the washing tub, and kinetic energy is applied to the received water.

The suspension assembly includes a support rod, an elastic member, and the damper. The support rod is formed in a rod shape, and one end of the support rod is coupled to the main body. The elastic member is arranged about the support rod to surround the support rod.

The damper is supported on the elastic member, and is configured to move along the longitudinal direction of the support rod. In addition, the damper is coupled to the outer circumference of the support rod, and forms a compartment, which is an empty space surrounding the support rod. The compartment is provided with a friction member. At least a portion of the load of the main body is supported on the damper.

In an embodiment of the present disclosure, the suspension assembly includes a coupling portion and a support member. The coupling portion is formed at one end of the support rod, and is coupled to the main body so as to be rotatable in at least one direction. The support member is coupled to the other end of the support rod, and supports the elastic member.

The elastic member is interposed between the damper and the support member to be elastically deformable between the damper and the support member.

In an embodiment of the present disclosure, the damper includes a stepped protrusion. The stepped protrusion comes into contact with the elastic member. The load applied from the washing tub is transmitted to the elastic member by bringing an outer circumference of the damper into contact with a holder provided in the washing tub.

In an embodiment of the present disclosure, the damper includes a cap and a housing. The cap is provided with a first through hole through which the support rod passes, and receives the load of the washing tub by coming into contact with the holder provided in the washing tub. The housing includes a compartment formed therein by being coupled to the cap, a second through hole through which the support rod passes, and a stepped protrusion formed on an outer circumference of the housing to come into contact with the elastic member.

In an embodiment of the present disclosure, the compartment is filled with lubricant.

In an embodiment of the present disclosure, the damper includes a fixing guide. The fixing guide surrounds at least a portion of the outer circumference of the friction member in order to cause the friction member to come into contact with the outer surface of the support rod while applying a predetermined pressure to the outer surface of the support rod.

In an embodiment of the present disclosure, the fixing guide includes an extending protrusion. The extending protrusion protrudes radially around the support rod, and is spaced apart from an inner surface of the housing.

In an embodiment of the present disclosure, the fixing guide is formed in a cylindrical shape, and at least two friction members are fixed in contact with the support rod inside the fixing guide. Between the friction members is disposed a boundary wall that protrudes inward from an inner circumference of the cylindrical fixing guide In an embodiment of the present disclosure, the damper includes a first friction protrusion and a second friction protrusion. The first friction protrusion is formed around the first through hole and protrudes in the direction of the friction member. The second friction protrusion is formed around the second through hole and protrudes in the direction of the friction member.

In an embodiment of the present disclosure, each surface of the first friction protrusion and the second friction protrusion that comes into contact with the friction member is formed as a curved surface.

In an embodiment of the present disclosure, the friction member includes a plurality of protruding uneven portions on one surface of the friction member in contact with the support rod.

In an embodiment of the present disclosure, the friction member includes a plurality of groove-shaped uneven patterns on one surface of the friction member in contact with the support rod.

In an embodiment of the present disclosure, the uneven patterns are formed with long grooves that form a predetermined pattern.

In addition, a laundry treating apparatus according to an embodiment of the present disclosure includes a suspension assembly. The suspension assembly is coupled between a main body and a washing tub. In addition, the suspension assembly transmits the load of the washing tub to the main body, and attenuates the kinetic energy occurring in the washing tub.

The suspension assembly includes a support rod, a coupling portion, and a damper. The support rod is formed in a rod shape having a predetermined length. The coupling portion is formed at one end of the support rod, and is rotatably coupled to the main body. The damper is coupled to the support rod so as to be movable along the longitudinal direction of the support rod, but the movement of the damper in one direction is limited by an elastic force applied by an elastic member.

In addition, a compartment through which the support rod passes is formed as a predetermined space in the damper, and the compartment is filled with a lubricant.

In addition, the damper includes a first friction member and a second friction member, wherein the first friction member is received in the compartment to surround at least a portion of the outer circumference of the support rod and to be spaced apart from a side wall of the compartment. The second friction member is received in the compartment so as to surround the outer circumference of the support rod and to come into close contact with the side wall of the compartment In an embodiment of the present disclosure, the damper further includes a supporter. The supporter is interposed between the first friction member and the second friction member, and is configured to compress the second friction member toward the support rod by surrounding at least a portion of an outer circumference of the second friction member.

In an embodiment of the present disclosure, the supporter includes a main plate and a constraining piece. The main plate is provided with a third through hole through which the support rod passes, and is formed in a plate shape to divide the compartment into two spaces.

A laundry treating apparatus according to an embodiment of the present disclosure includes a support rod and a damper. One end of the support rod is rotatably coupled to the main body, and the other end of the support rod is coupled to the support member. The damper is coupled to the support rod so as to surround an outer circumference of the support rod, an elastic member is interposed between the damper and the support member, and the damper supports the load of the main body.

In addition, the damper includes a cap, a housing, and a friction member. The cap comes into contact with the main body and receives the load of the main body. The housing is coupled to the cap, and forms a compartment, which is a space of a predetermined size between the cap and the housing. The friction member is disposed in the compartment to generate a frictional force over a predetermined size by pressing the outer circumference of the support rod passing through the compartment. The compartment is filled with lubricant.

According to the embodiments of the present disclosure, since a frictional force is evenly distributed on a contact surface of the support rod and the friction member in the process of reducing the movement of the washing tub due to the load and vibration of the washing tub, buffering performance can be improved.

According to the embodiments of the present disclosure, since in the suspension assembly supporting the load of the washing tub, the components receiving the force applied from the washing tub are prevented from being spaced apart from each other, noise caused by vibration can be reduced during operation of the washing tub.

According to the embodiments of the present disclosure, since in the process of dampening vibration of the washing tub, friction heat occurring in the support rod and the friction member is dissipated through a lubricant disposed to surround the friction member, durability and buffering efficiency can be improved.

According to the embodiments of the present disclosure, since the friction member and the support rod are coupled to each other through the fixing guide, and the compartment in which the friction member is disposed has a simple structure formed through the coupling of the cap and the housing, the number of components may be reduced and assembly of the components can be facilitated.

According to the embodiments of the present disclosure, since in the process of dampening vibration occurring in the washing tub, no shock is applied to the friction member, and the friction member has a friction surface on which grooves or protrusions are formed, high durability can be achieved despite repeated occurrence of friction.

According to the embodiments of the present disclosure, since two friction members are disposed, and at least one of the friction members is formed to prevent the lubricant from escaping, the buffering efficiency can be improved, and a stable buffering action can be performed.

The effects of the present disclose are not limited to those mentioned above, and other effects not mentioned can be clearly understood by those skilled in the art from the following description.

DETAILED DESCRIPTION

Figure 1:
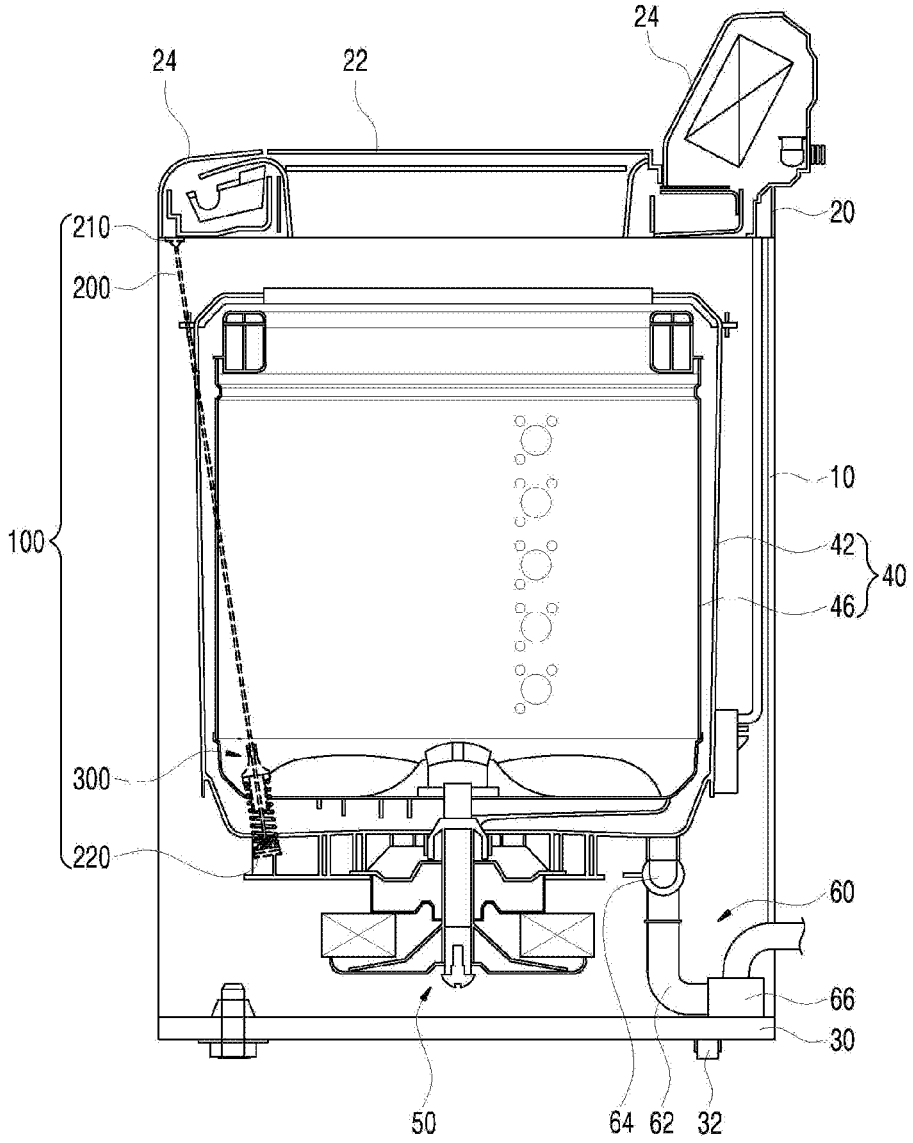
FIG. 1 is a cross-sectional view of a laundry treating apparatus according to an embodiment of the present disclosure.

Hereinafter, the embodiments of the present disclosure as described above will be described in detail with reference to the accompanying drawings. The like reference numerals refer to the like components throughout the detailed description.

FIG. 1 is a cross-sectional view of a laundry treating apparatus according to an embodiment of the present disclosure.

As illustrated in FIG. 1, a main body 10 is coupled to a top cover 20 and a base 30 so as to form the exterior of the laundry treating apparatus according to an embodiment of the present disclosure.

The main body 10 includes a receiving space formed therein. The base 30 is coupled to a bottom surface of the main body 10, and the top cover 20 is coupled to a top surface of the main body 10.

The base 30 supports the load of the main body 10. The base 30 stably fixes the main body 10.

The base 30 includes four legs 32 that protrude downward from a bottom surface of the base 30, and the protruding length of each of the legs 32 may be adjusted.

The level of the base 30 and the main body 10 may be adjusted by adjusting the protruding length of each of the legs 32. In addition, the base 30 and the main body 10 may be firmly seated on a floor surface without shaking, by adjusting the protruding length of each of the legs 32.

The base 30 and the legs 32 together support the laundry treating apparatus according to an embodiment of the present disclosure, and prevent the shaking or tilting of the laundry treating apparatus by stably transmitting the load of the laundry treating apparatus to the floor surface.

The main body 10 is coupled to the base 30 so as to be seated on the base 30. The main body 10 includes a space formed therein. Components such as a washing tub 40 and a drain portion 60 are installed inside the main body 10.

The top cover 20 is coupled to a top surface of the main body 10. The top cover 20 includes a door 22 that may be opened and closed. The door 22 may be a top-down type, and when the door 22 is opened, the inside of the main body 10, specifically, the washing tub 40 installed inside the main body 10 is opened. When the washing tub 40 is opened through the opening of the door 22, the laundry may be loaded into the washing tub 40.

Subsequently, when the door 22 is closed, the washing tub 40 is isolated from the outside.

The operation of the washing tub 40 in a state in which the door 22 is opened may be prevented through a sensor attached to the door 22. The door 22 may be automatically opened or closed, but this is merely exemplary, and the door 22 may be implemented in an appropriate type according to an embodiment of the present disclosure.

In addition, a control panel 24 may be provided at a position adjacent to the door 22 or at a position easily recognized by a user.

The control panel 24 may include a display and a manipulation portion.

A command may be inputted to the laundry treating apparatus according to an embodiment of the present disclosure through an operation such as touching or pressing the manipulation unit. The operating state and information of the laundry treating apparatus may be displayed on the display.

The washing tub 40 is installed in a space inside the main body 10. The washing tub 40 includes an outer tub 42 and an inner tub 46.

The outer tub 42 is coupled to the main body 10 in the space inside the main body 10. The inner tub 46 is received in the outer tub 42.

The outer tub 42 is coupled to the main body 10 through a support member 220. The support member 220 is provided with a damper. Accordingly, although the load of the outer tub 42 is supported on the main body 10, the outer tub 42 may make a predetermined movement relative to the main body 10. As a result, vibration or shock applied to the outer tub 42 may be reduced by means of the support member 220.

Water may be received in the outer tub 42. The outer tub 42 is composed of a bottom surface and a side wall. The inner tub 46 is coupled to the outer tub 42 so as to rotate inside the outer tub 42. When the inner tub 46 rotates inside the outer tub 42, water received in the outer tub 42 generates a predetermined water flow.

The inner tub 46 is sized to be received in the outer tub 42, and is composed of a bottom surface and a side wall. The inner tub 46 is provided with a loading hole that is opened upward.

The bottom surface of the inner tub 46 is coupled to the drive portion 50, such that the inner tub 46 may rotate in a predetermined direction by means of the driving of the drive portion 50.

When water is supplied to the outer tub 42 through a water supply inlet coupled to an external water supply, the outer tub 42 is filled with washing water. Washing water in the outer tub 42 also flows into the inner tub 46 through the opened holes formed in the inner tub 46. When washing or rinsing is performed, washing water received in the outer tub 42 generates a series of water flows by means of rotation of the inner tub 46, and washing or rinsing is performed by the water flows.

When spin-drying or draining is performed, the drain valve 64 is opened, and water received in the outer tub 42 is discharged to the outside through the drain valve 64 and a drain passage 62. The drain passage 62 may further include a separate drain pump 66. The drain pump 66 may serve to allow washing water received in the washing tub 40 to be discharged more smoothly to the outside.

Figure 2:
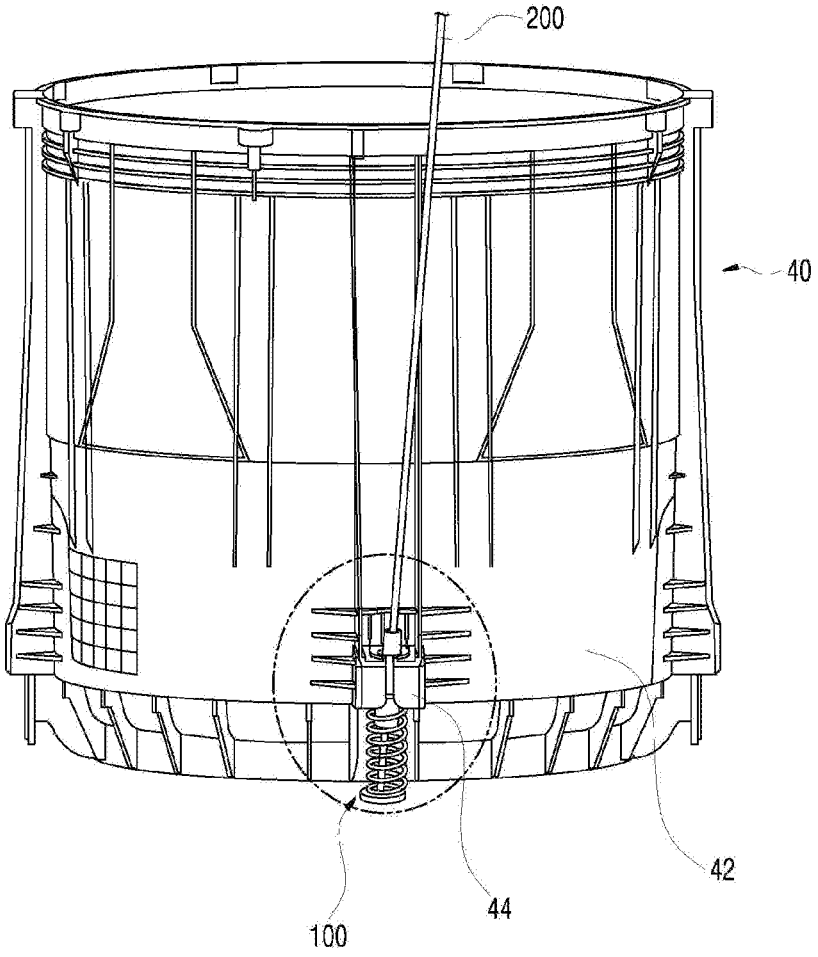
FIG. 2 is a perspective view of a washing tub in a laundry treating apparatus according to an embodiment of the present disclosure.
Figure 3:
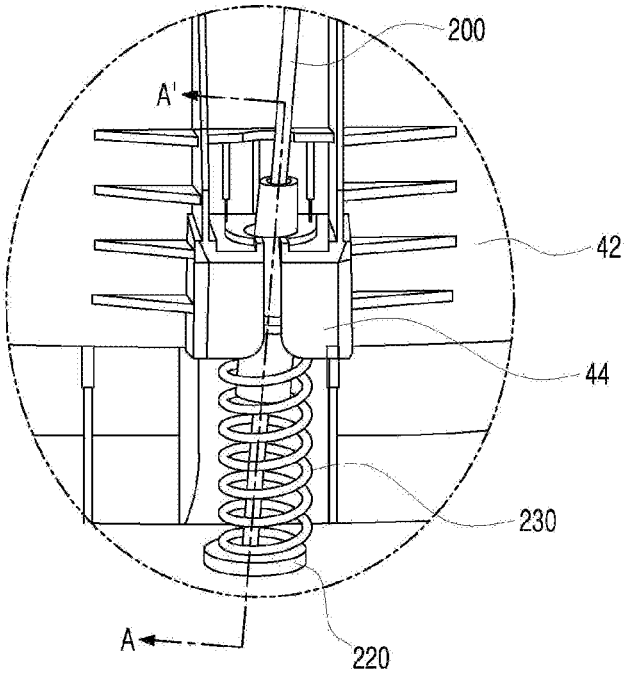
FIG. 3 is a perspective view illustrating a suspension assembly in a laundry treating apparatus according to an embodiment of the present disclosure.

FIG. 2 is a perspective view of the washing tub 40 in the laundry treating apparatus according to an embodiment of the present disclosure, and FIG. 3 is a perspective view illustrating a suspension assembly 100 in the laundry treating apparatus according to an embodiment of the present disclosure.

As illustrated in FIGS. 2 and 3, the washing tub 40 is coupled to the main body 10 inside the main body 10. The main body 10 and the washing tub 40 are coupled to each other through the suspension assembly 100. The washing tub 40 may be coupled to at least one suspension assembly 100. The washing tub 40 is coupled to the main body 10 so as to make a predetermined movement. The washing tub 40 is coupled to the main body 10 at least two points on the washing tub 40, and the load of the washing tub 40 is supported on the main body 10. In the laundry treating apparatus according to an embodiment of the present disclosure, at least two suspension assemblies 100 are coupled to the outer circumference of the washing tub 40. The suspension assemblies 100 serve to couple the washing tub 40 to the main body 10. The washing tub 40 may be hinged to the main body 10 at one point of the outer circumference of the washing tub 40.

The suspension assembly 100 is interposed between the main body 10 and the washing tub 40 in order to support the load of the washing tub 40 and to absorb vibration occurring in the washing tub 40.

Figure 4:
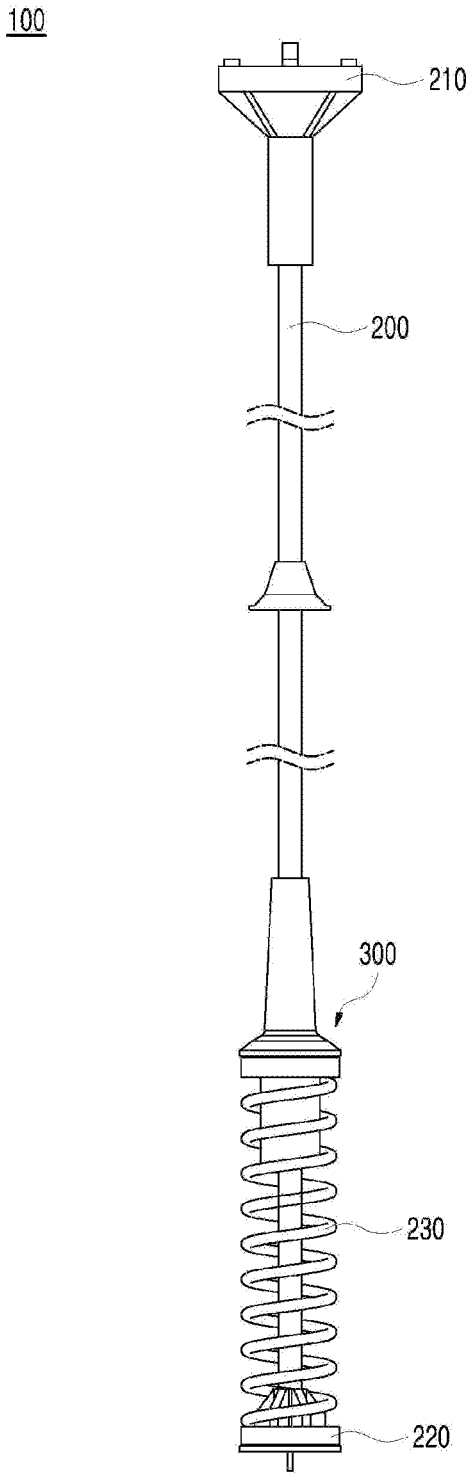
FIG. 4 is front view illustrating a suspension assembly in a laundry treating apparatus according to an embodiment of the present disclosure.
Figure 5:
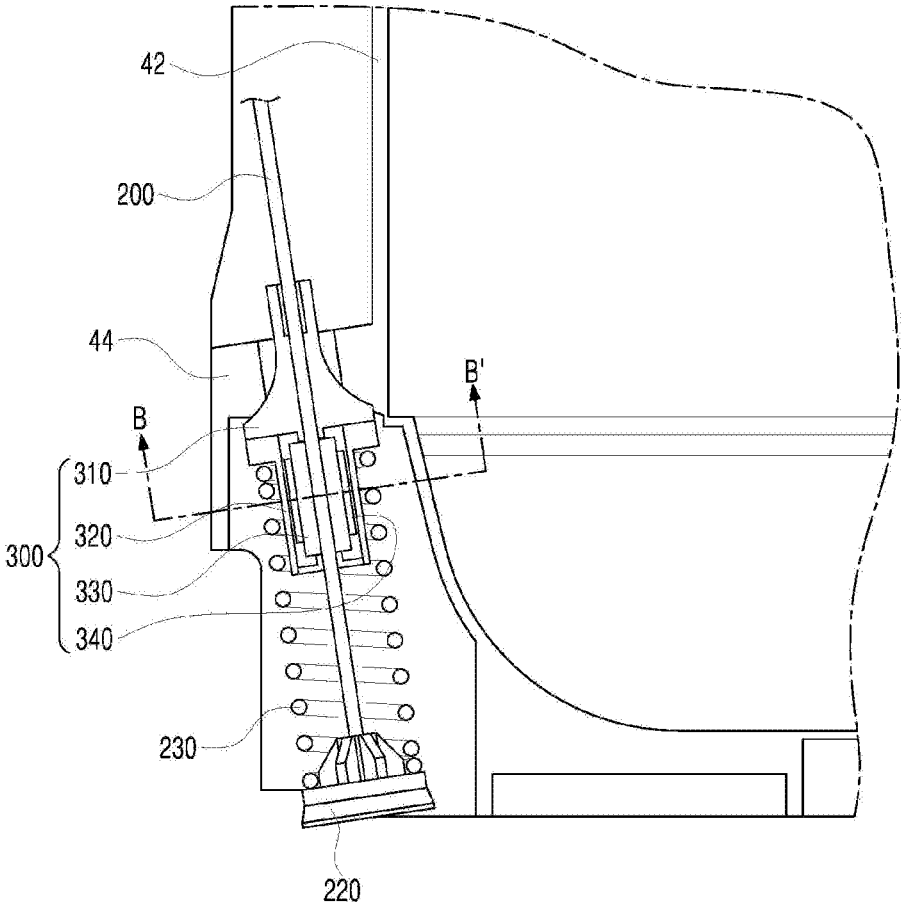
FIG. 5 is a cross-sectional view taken along line A-A' of FIG. 3

FIG. 4 is front view illustrating the suspension assembly 100 in the laundry treating apparatus according to an embodiment of the present disclosure, and FIG. 5 is a cross-sectional view taken along line A-A' of FIG. 3.

As illustrated in FIGS. 4 and 5, the suspension assembly 100 includes a support rod 200, a coupling portion 210, a support member 220, an elastic member 230, and a damper 300.

The coupling portion 210 is disposed at one end of the support rod 200, and the support member 220 is disposed at the other end of the support rod 200. The coupling portion 210 is where the suspension assembly 100 is coupled to the main body 10, and is formed such that the support rod 200 is rotatably coupled to the main body 10.

The support member 220 is formed at the other end of the support rod 200, and is formed with a predetermined width in a direction perpendicular to the longitudinal direction of the support member 220. In the laundry treating apparatus according to an embodiment of the present disclosure, the support member 220 may be formed in a circular plate shape. The support member 220 may be coupled to the other end of the support rod 200, but may have a shape that extends to the outside of the support rod 200.

The elastic member 230 is arranged about the support rod 200 to surround the support rod 200. One end of the elastic member 230 is coupled to the support member 220 to prevent the elastic member 230 from being separated from the support rod 200.

The elastic member 230 is interposed between the support member 220 and the damper 300. Accordingly, when an external force is applied to the damper 300, the elastic member 230 is compressed, and when the external force applied to the damper 300 is removed, the elastic member 230 returns to its original state.

The support rod 200 may be formed in a rod shape. The support rod 200 has a predetermined length. One end of the support rod 200, which is provided with the coupling portion 210, faces upward, while the other end of the support rod 200, which is provided with the support member 220, faces downward.

The damper 300 is coupled to the support rod 200 to surround the outer circumference of the support rod 200. The damper 300 is configured to slide along the longitudinal direction of the support rod 200.

As described above, since the damper 300 comes into contact with the elastic member 230, the damper 300 is affected by the elastic force of the elastic member 230 when moving in one direction.

In addition, a holder 44 is mounted over the damper 300. The holder 44 is formed at the lower portion of the outer tub 42. Specifically, the holder 44 is positioned at the lower portion of the outer circumference of the outer tub 42. The same number of holders 44 as the dampers 300 may be mounted.

The load of the washing tub 40 and vibration occurring in the washing tub 40 are transmitted to the damper 300 through the holder 44. Accordingly, when an external force is applied to the damper 300 through the holder 44, the elastic member 230 is compressed, and the damper 300 reciprocates vertically along the support rod 200 by the elastic force of the elastic member 230.

The damper 300 maintains a predetermined frictional force against the support rod 200. Accordingly, when an external force from the washing tub 40 is applied to the elastic member 230 to press the elastic member 230, the damper 300 moves vertically according to the behavior of the elastic member 230. However, since the frictional force generated between the damper 300 and the support rod 200 attenuates the behavior of the elastic member 230, abrupt movement of the damper 300 is prevented.

That is, the load of the washing tub 40 and the external force generated in the washing tub 40 are transmitted to the damper 300. The damper 300 attenuates the external force transmitted from the washing tub 40. Both the elastic force of the elastic member 230 and the frictional force generated at the coupling position of the damper 300 and the support rod 200 are applied to the damper 300. Since the elastic force and the frictional force are simultaneously applied to the damper 300, a buffering effect occurs in the damper 300.

Figure 6:
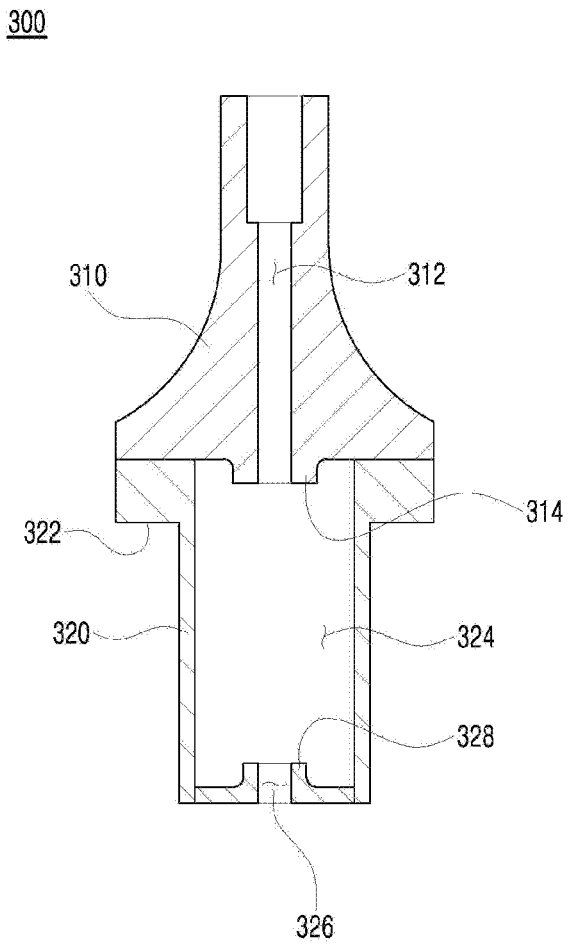
FIG. 6 is a partial cross-sectional view illustrating a portion of the damper in the laundry treating apparatus according to an embodiment of the present disclosure.
Figure 7:
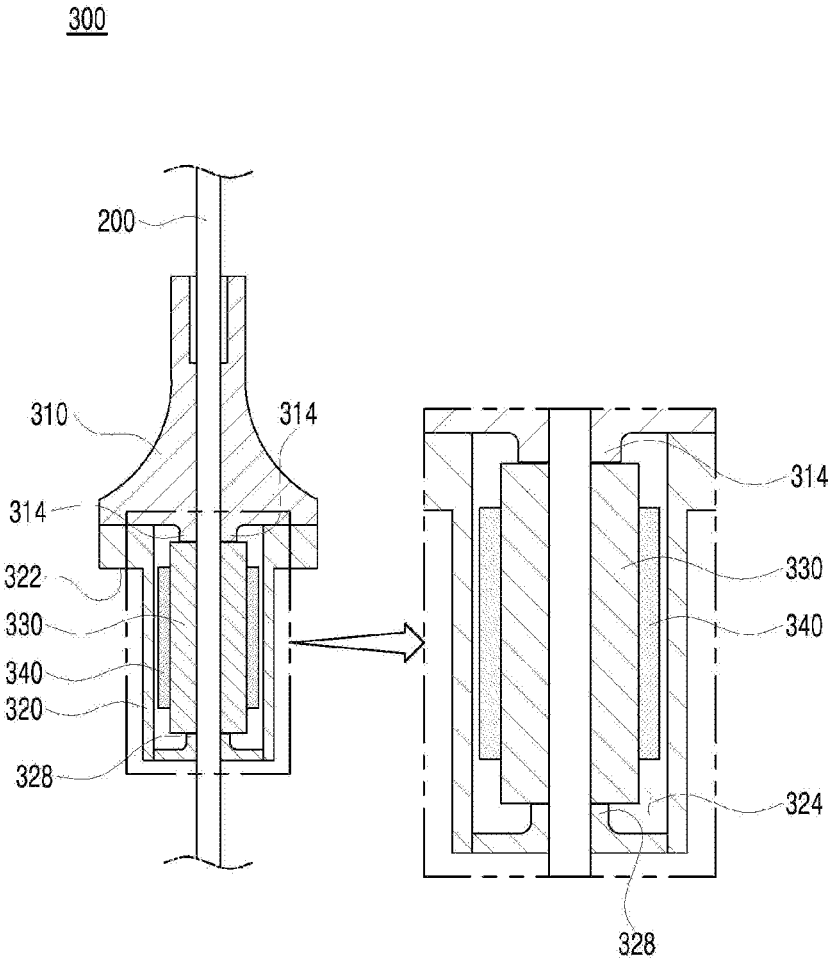
FIG. 7 is a cross-sectional view illustrating a damper in a laundry treating apparatus according to an embodiment of the present disclosure.

FIG. 6 is a partial cross-sectional view illustrating a portion of the damper 300 in the laundry treating apparatus according to an embodiment of the present disclosure. FIG. 7 is a cross-sectional view illustrating the damper 300 in a laundry treating apparatus according to an embodiment of the present disclosure.

As illustrated FIGS. 6 and 7, the damper 300 may include a cap 310, a housing 320, and a friction member 330.

The cap 310 and the housing 320 are coupled to each other. In addition, a predetermined space is formed in the inner region where the cap 310 and the housing 320 are coupled to each other. The inner space where the cap 310 and the housing 320 are coupled to each other is defined as a compartment 324.

A first through hole 312 and a second through hole 326 through which the support rod 200 passes are formed in the cap 310 and the housing 320, respectively. Accordingly, the support rod 200 penetrates the cap 310 and the housing 320 and passes through the compartment 324.

The cap 310 and the housing 320 may be coupled to each other through a fastening means such as a bolt, or may be coupled to each other by forming mutually meshed threads in the contact portion of the cap 310 and the housing 320, respectively. However, this is merely exemplary, and the coupling may be made in a variety of ways according to embodiments to which the disclosure is applied.

As described above, one end of the support rod 200, which is provided with the coupling portion 210, faces upward, while the other end of the support rod 200, which is coupled to the support member 220, faces downward. The cap 310 is adjacent to the coupling portion 210, and the housing 320 is arranged adjacent to the support member 220. This is intended to allow the holder 44 formed in the outer tub 42 to be seated on the cap 310.

The outer circumference of the cap 310 widens downward based on the directions illustrated in FIGS. 6 and 7. This is intended to allow the holder 44 to be seated while applying a load to the cap 310 by coming into contact the cap 310.

In an embodiment of the present disclosure, the compartment 324 may be formed inside the housing 320, and the compartment 324 may be closed through the coupling of the cap 310 and the housing 320.

The compartment 324 is an internal space formed by the coupling of the housing 320 and the cap 310.

In the housing 320, a stepped protrusion 322 in contact with the elastic member 230 is formed on the opposite side to the side to which the cap 310 is coupled. The stepped protrusion 322 in contact with the elastic member 230 is formed to allow a portion of the outer shape of the housing 320 to protrude laterally, and the elastic member 230 is interposed between the support member 220 and the housing 320.

The compartment 324 has a volume sufficient to be penetrated by the support rod 200, and a predetermined space is formed around the support rod 200.

The friction member 330 comes into contact with the outer circumference of the support rod 200, and surrounds at least a portion of the outer circumference of the support rod 200.

The friction member 330 is coupled to the support rod 200 through a fixing guide 340. The fixing guide 340 is coupled to the outer circumference of the friction member 330. In addition, the fixing guide 340 presses the friction member 330 toward the support member 220.

The friction member 330 is made of a material such as rubber, fiber, or felt, which has a large surface frictional force. The friction member 330 may be deformed in appearance by an external force, and may have a predetermined elastic force.

The fixing guide 340 surrounds at least a portion of the outer circumference of the friction member 330, and presses the friction member 330 to bring the friction member 330 into contact with the support rod 200.

In addition, the friction member 330 is spaced apart from the side wall of the compartment 324, but both ends of the friction member 330 come into contact with the inner surfaces of the cap 310 and the housing 320 along the longitudinal direction of the support rod 200.

Accordingly, when the load and vibration of the washing tub 40 is applied to the cap 310, the cap 310 is configured to slide downward along the support rod 200. At this time, the cap 310 presses both the elastic member 230 and the friction member 330 at the same time. Since the friction member 330 comes into close contact with the outer circumference of the support rod 200 inside the compartment 324, a frictional force is generated between the friction member 330 and the support rod 200, which prevents movement the friction member 330 and the support rod 200.

Accordingly, since the elastic force of the elastic member 230 and the frictional force generated between the friction member 330 and the support rod 200 work together, the external force applied from the washing tub 40, specifically, the load and vibration of the washing tub 40, can be attenuated.

In an embodiment of the present disclosure, the compartment 324 is filled with lubricant. The lubricant has a heat dissipation effect, and also reduces friction generated between the friction member 330 and the support rod 200 to some extent. Accordingly, attenuation of vibration and shock by means of the suspension assembly 100 can be achieved more smoothly, and the lifespan of the components related to friction can be increased.

In addition, the first through hole 312 is formed in the cap 310. At a position adjacent to the first through hole 312, a first friction protrusion 314 protrudes toward the compartment 324. The first friction protrusion 314 comes into contact with the friction member 330.

The second through hole 326 is formed in the housing 320. At a position adjacent to the second through hole 326, a second friction protrusion 328 protrudes toward the compartment 324. The second friction protrusion 328 comes into contact with the other side of the friction member 330.

Accordingly, referring to FIG. 7, the upper end of the friction member 330 comes into contact with the first friction protrusion 314, and the lower end of the friction member 330 comes into contact with the second friction protrusion 328. As a result, in the process of friction occurring due to the contact between the friction member 330 and the support rod 200, the friction member 330 does not rotate about the axial direction of the support rod 200.

Each surface of the first friction protrusion 314 and the second friction protrusion 328 that comes into contact with the friction member 330 may be formed as a curved surface.

FIGS. 8 to 11 are cross-sectional views taken along line B-B' of FIG. 5.

FIGS. 8 to 11 illustrate some examples in which the friction member 330 is coupled to the outer circumference of the support rod 200 inside the compartment 324.

The friction member 330 is coupled to the fixing guide 340 so as to be in close contact with the outer circumference of the support rod 200.

Figure 8:
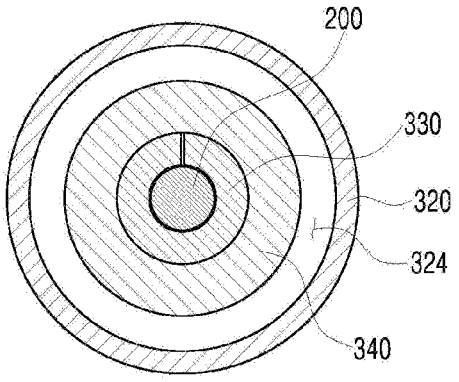
FIGS. 8 to 11 are cross-sectional views taken along line B-B' of FIG. 5.

First, as illustrated in FIG. 8, the friction member 330 is in surface contact with the outer circumference of the support rod 200.

The fixing guide 340 surrounds at least a portion of the outer circumference of the friction member 330. The fixing guide 340 is made of a more rigid material than the friction member 330, and presses the friction member 330 toward the support rod 200.

Figure 9:
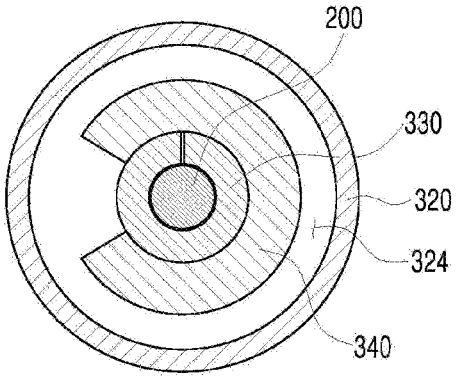

The fixing guide 340 may surround only a portion of the outer circumference of the friction member 330, as illustrated in FIG. 9. The fixing guide 340 may have a 'C'-shaped cross section. This facilitates the process of assembling the friction member 330 to the outer surface of the support rod 200, and also results in saving of materials in manufacturing the fixing guide 340.

Figure 10:
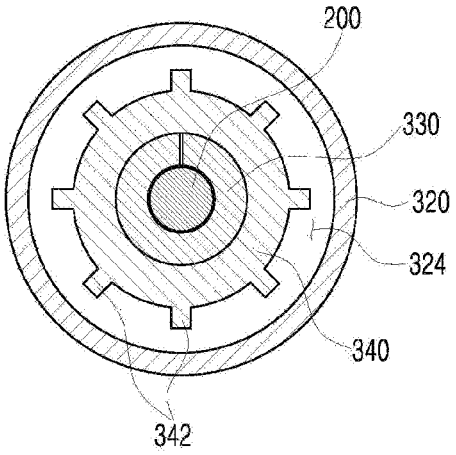

In addition, as illustrated in FIG. 10, the fixing guide 340 may include a plurality of extending protrusions 342 that protrude outward. The extending protrusions 342 are adjacent to the inner wall of the compartment 324 but spaced apart therefrom by a predetermined distance. The extending protrusions 342 prevent the damper 300 and the support rod 200 from deviating from a predetermined position inside the compartment 324.

Figure 11:
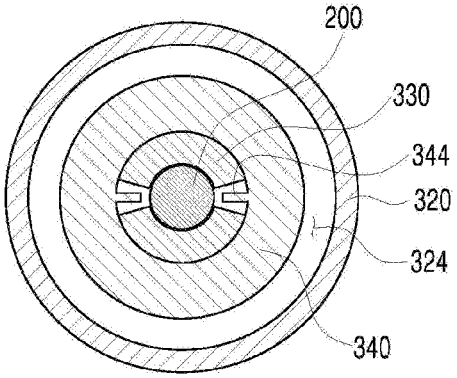

As illustrated in FIG. 11, the inner circumference of the fixing guide 340 may be provided with at least one boundary wall 344. The boundary wall 344 limits movement of the friction member 330 arranged in the inner space of the fixing guide 340. The boundary wall 344 allows a plurality of friction members 330 to be coupled to the inner surface of the fixing guide 340. This may result in improvement of ease of assembly as well as saving of materials in manufacturing the friction member 330.

Figure 12:
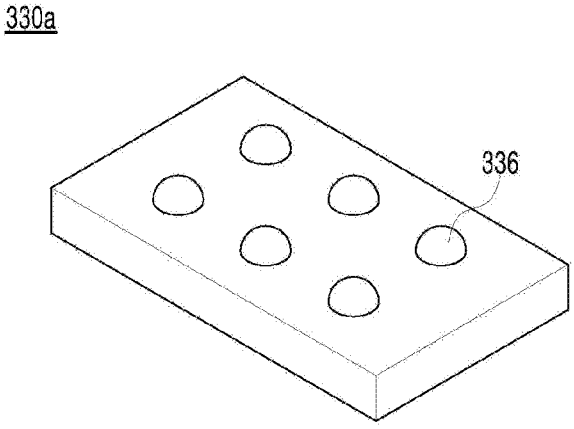
FIGS. 12 to 14 are perspective views illustrating friction members in a laundry treating apparatus according to an embodiment of the present disclosure.
Figure 13:
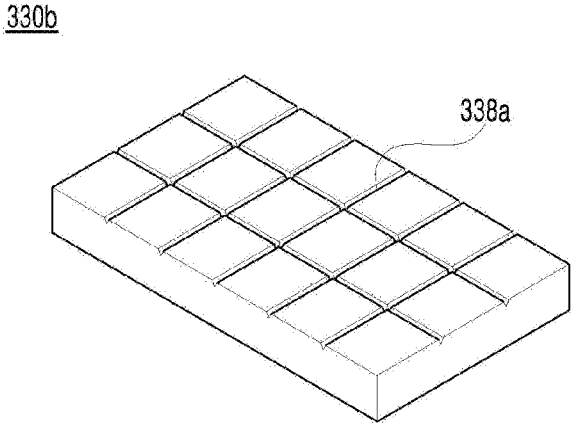
Figure 14:
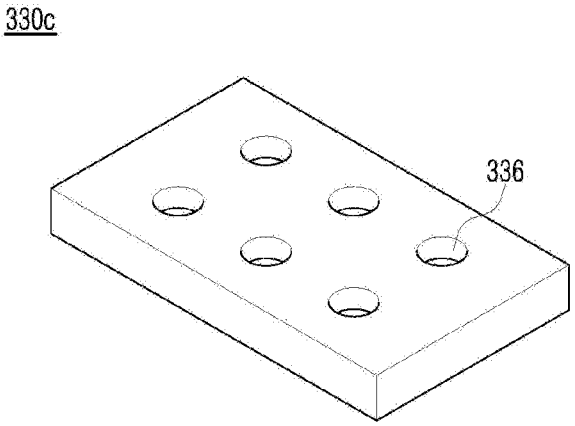

FIGS. 12 to 14 are perspective views illustrating the friction members 330 in a laundry treating apparatus according to an embodiment of the present disclosure.

As illustrated in FIGS. 12 to 14, the friction member 330 may be formed in a plate shape of which both surfaces are wide and which has a predetermined thickness.

The friction member 330 may include an uneven portion 336 and an uneven pattern 338 of a protruding or recessed shape on the surface in contact with the support rod 200.

A plurality of uneven portions 336 may be provided. The uneven portion 336 may be formed in a protruding shape such as a hemisphere shape, as shown in FIG. 12.

In the uneven pattern 338, the protruding or recessed shape forms a predetermined pattern, as illustrated in FIG. 13. The uneven pattern 338 may be a predetermined pattern such as a grid pattern or a wave pattern.

As illustrated FIG. 14, the uneven portion 336 may be formed of a plurality of recessed grooves.

The uneven portion 336 and the uneven pattern 338 are formed on one surface of the friction member 330 on which friction occurs, such that the frictional force generated between the friction member 330 and the support rod 200 is increased.

Figure 15:
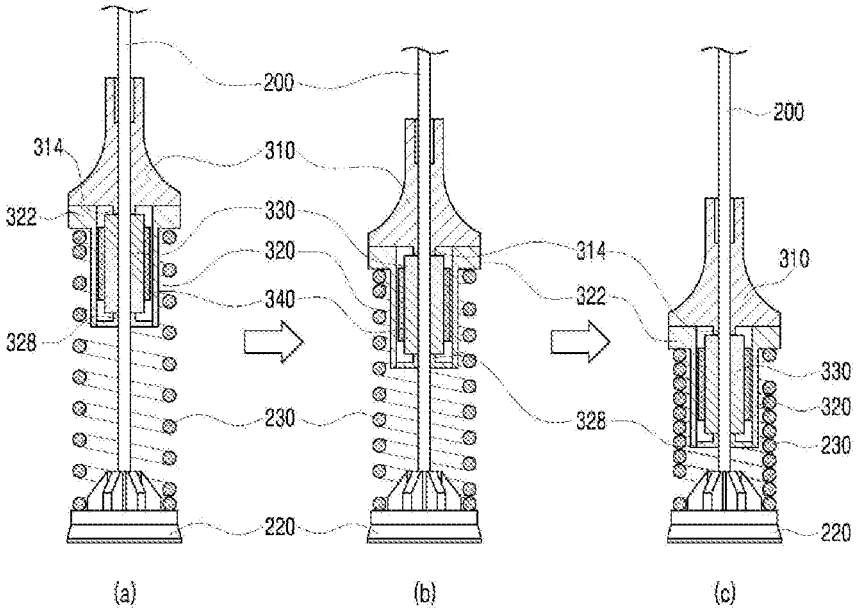
FIG. 15 is a view illustrating an operating state of a suspension assembly in a laundry treating apparatus according to an embodiment of the present disclosure.

FIG. 15 is a view illustrating an operating state of the suspension assembly 100 in the laundry treating apparatus according to an embodiment of the present disclosure.

According to an embodiment of the present disclosure, the external force from the washing tub 40 is transmitted to the cap 310, as illustrated in FIG. 15. The cap 310 slides downward by the external force applied from the washing tub 40, and at this time, the elastic member 230 is elastically deformed to be compressed. In the process of the damper 300 sliding downward along the support rod 200, the friction member 330 comes into contact with the outer circumference of the support rod 200, thereby generating friction between the friction member 330 and the support rod 220. The frictional force generated between the friction member 330 and the support rod 200 works together with the elasticity of the elastic member 230 to smoothly attenuate the external force transmitted from the washing tub 40.

Figure 16:
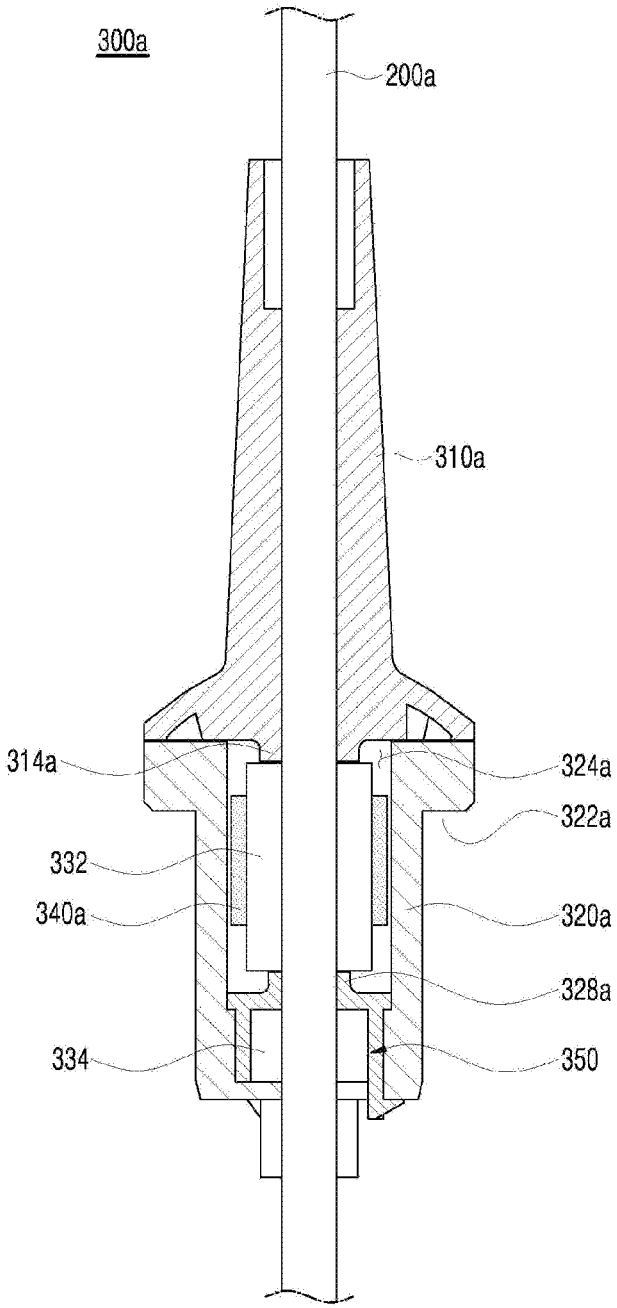
FIG. 16 is a cross-sectional view illustrating a damper in a laundry treating apparatus according to another embodiment of the present disclosure.
Figure 17:
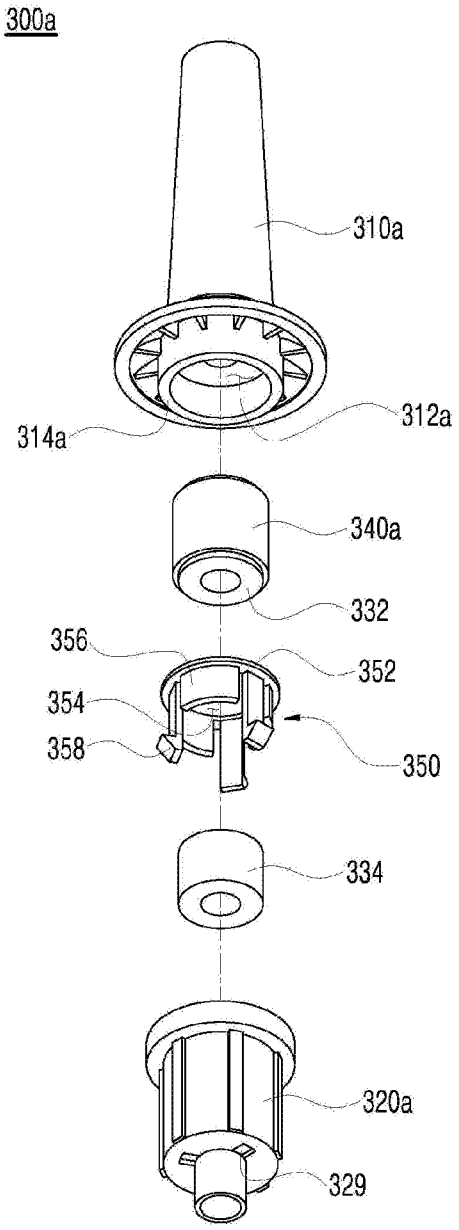
FIG. 17 is an exploded perspective view of a damper in a laundry treating apparatus according to another embodiment of the present disclosure.

FIG. 16 is a cross-sectional view illustrating the damper in the laundry treating apparatus according to another embodiment of the present disclosure, and FIG. 17 is an exploded perspective view of the damper in the laundry treating apparatus according to another embodiment of the present disclosure.

According to another embodiment of the present disclosure, the damper may further include a supporter 350, as illustrated FIGS. 16 and 17.

The supporter 350 includes a main plate 352, a constraining piece 356, and a fixing piece 358. The main plate 352 has the same shape as the cross-sectional shape of the compartment 324*a*, and divides the compartment 324*a* into two spaces.

The main plate 352 includes, at its center, a third through hole 354 that is opened to be penetrated by a support rod 200*a*.

Accordingly, the compartment 324*a* may be divided into two spaces based on the main plate 352, and the first friction member 332 may be arranged at a position close to a cap 310*a* inside a compartment 324*a*. The friction member 330 is in surface contact with the support rod 200 to surround the support rod 200. The first friction member 332 is fixed by a fixing guide 340*a*. The top of the first friction member 332 comes into contact with a first friction protrusion 314*a*, while the lower end of the first friction member 332 comes into contact with a second friction protrusion 328*a* formed around the third through hole 354 of the main plate 352. A space around the friction member 332 is filled with lubricant.

Referring to FIG. 17, the main plate 352 includes the constraining piece 356 and the fixing piece 358 that protrude downward. The constraining piece 356 surrounds the second friction member 334 such that the second friction member 334 comes into close contact with the support rod 200*a*. The fixing piece 358 is fixed by passing through a fixing hole 329 formed in a housing 320*a*. A plurality of constraining pieces 356 and fixing pieces 358 may be provided. As the fixing piece 358 passes through the fixing hole 329, at least a portion of the fixing piece 358 may be exposed outside the housing 320*a*. The fixing piece 358 may be made of an elastic material. The fixing piece 358 may be fixed to a predetermined position inside the compartment 324*a* by latching to an outer wall of the housing 320*a* through a latching protrusion provided at the end of the fixing piece 358.

In the above, the embodiments of the present disclosure have been described with reference to the accompanying drawings, but these are exemplary. Therefore, the present disclosure should not be limited to the embodiments and drawings as described above. It will be apparent to those skilled in the art that various other changes and modifications can be made without departing from the spirit and scope of the disclosure. In addition, although not all actions or effects according to the configurations of the embodiments have been explicitly described, it is apparent that predictable actions or effects from the configurations should also be recognized as falling within the spirit and scope of the present disclosure.

What is claimed is:

1. A laundry treating apparatus comprising:

a main body that defines a receiving space therein;

a washing tub disposed in the receiving space; and one or more suspension assemblies that couple the washing tub to the main body and support the washing tub on the main body, wherein the one or more suspension assemblies comprise:

a support rod coupled to the main body, an elastic member that is arranged about the support rod and surrounds the support rod, and a damper disposed at a first end of the elastic member and configured to move along a longitudinal direction of the support rod, the damper being coupled to an outer circumference of the support rod and defining a compartment that surrounds the support rod, wherein the washing tub comprises a holder disposed at position corresponding to the damper, and wherein the damper comprises:

a friction member that is disposed in the compartment and contacts the support rod, the friction member surrounding at least a portion of the outer circumference of the support rod, a cap that defines a first through hole receiving the support rod, the cap being configured to support a load of the washing tub based on contacting the holder of the washing tub, a housing that defines the compartment based on coupling to the cap and that defines a second through hole receiving the support rod, the housing comprising a stepped protrusion that is disposed at an outer circumference of the housing and configured to contact the first end of the elastic member, wherein the support rod passes through the first through hole, the compartment, and the second through hole, a fixing guide that surrounds at least a portion of an outer circumference of the friction member, the fixing guide being configured to apply pressure to the friction member to thereby allow the friction member to contact an outer surface of the support rod, wherein the friction member extends to positions above and below the fixing guide, a first friction protrusion that is disposed along a boundary of the first through hole and protrudes from the cap toward the friction member, the first friction protrusion having a first surface configured to contact a first end of the friction member, and a second friction protrusion that is disposed along a boundary of the second through hole and protrudes from the housing toward the friction member, the second friction protrusion having a second surface configured to contact a second end of the friction member opposite to the first end of the friction member.

2. The laundry treating apparatus according to claim 1, wherein the one or more suspension assemblies further comprise:

a coupling portion disposed at a first end of the support rod and rotatably coupled to the main body; and a support member coupled to a second end of the support rod and configured to support a second end of the elastic member, and wherein the elastic member is interposed between the damper and the support member and configured to be elastically deform based on the damper moving toward the support member.

3. The laundry treating apparatus according to claim 2, wherein the holder is coupled to the damper and configured to contact an outer circumference of the damper, and wherein the elastic member is configured to receive a load transmitted from the washing tub through the holder in contact with the outer circumference of the damper.

4. The laundry treating apparatus according to claim 2, wherein the support member has a plate shape.

5. The laundry treating apparatus according to claim 1, wherein the friction member has a cylindrical shape.

6. The laundry treating apparatus according to claim 1, wherein the elastic member comprises a coil spring that is disposed between the main body and the washing tub and that surrounds the support rod.

7. The laundry treating apparatus according to claim 1, wherein the compartment is filled with lubricant.

8. The laundry treating apparatus according to claim 1, wherein the fixing guide comprises a plurality of extending protrusions that are arranged about the support rod and protrude radially outward from an outer surface of the fixing guide with respect to the support rod, the plurality of extending protrusions being spaced apart from an inner surface of the housing.

9. The laundry treating apparatus according to claim 1, wherein the fixing guide has a cylindrical shape, wherein the friction member comprises a plurality of friction members that are fixed inside the fixing guide and contact the support rod, and wherein the fixing guide comprises at least one boundary wall that is disposed between two of the plurality of friction members and protrudes from an inner circumference of the fixing guide toward the support rod.

10. The laundry treating apparatus according to claim 1, wherein each of the first surface of the first friction protrusion and the second surface of the second friction protrusion has a curved shape.

11. The laundry treating apparatus according to claim 1, wherein the friction member comprises a plurality of protruding portions that protrude from an inner surface of the friction member facing the support rod, the plurality of protruding portions being configured to contact the support rod.

12. The laundry treating apparatus according to claim 1, wherein the friction member comprises a plurality of groove patterns that are recessed from an inner surface of the friction member facing the support rod.

13. The laundry treating apparatus according to claim 12, wherein the plurality of groove patterns comprise a plurality of grooves that extend one or more directions according to a predetermined pattern.

14. The laundry treating apparatus according to claim 1, wherein a length of the friction member along the support rod is equal to a distance between the first surface of the first friction protrusion and the second surface of the second friction protrusion.

15. The laundry treating apparatus according to claim 14, wherein a length of the fixing guide along the support rod is less than the length of the friction member such that the fixing guide is spaced apart from the first friction protrusion and the second friction protrusion.

16. The laundry treating apparatus according to claim 1, wherein an outer diameter of the friction member is greater than outer diameters of the first friction protrusion and the second friction protrusion.

* * * * *